US006619037B1

(12) United States Patent
Toyooka et al.

(10) Patent No.: US 6,619,037 B1
(45) Date of Patent: Sep. 16, 2003

(54) HYDRAULIC DRIVING DEVICE OF CIVIL ENGINEERING AND CONSTRUCTION MACHINERY

(75) Inventors: Tsukasa Toyooka, Higashiibaraki-gun (JP); Toichi Hirata, Ushiku (JP); Genroku Sugiyama, Inashiki-gun (JP); Kouji Ishikawa, Niihari-gun (JP); Masao Nishimura, Niihari-gun (JP); Tsuyoshi Nakamura, Niihari-gun (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/889,612

(22) PCT Filed: Jan. 18, 2000

(86) PCT No.: PCT/JP00/00201

§ 371 (c)(1),
(2), (4) Date: Jul. 19, 2001

(87) PCT Pub. No.: WO00/43601

PCT Pub. Date: Jul. 27, 2000

(30) Foreign Application Priority Data

Jan. 19, 1999 (JP) ..... 11-010833
Oct. 14, 1999 (JP) ..... 11-292637

(51) Int. Cl.[7] ..... F16D 31/02
(52) U.S. Cl. ..... 60/421; 60/430
(58) Field of Search ..... 60/421, 428, 429, 60/430

(56) References Cited

U.S. PATENT DOCUMENTS 3,720,059 A * 3/1973 Schurawski et al. ..... 60/421
5,692,377 A * 12/1997 Moriya et al. ..... 60/421
5,852,934 A * 12/1998 Chung et al. ..... 60/421

FOREIGN PATENT DOCUMENTS

| | | |
|---|---|---|
| JP | 3144024 | 6/1991 |
| JP | 5187041 | 7/1993 |
| JP | 116174 | 1/1999 |

* cited by examiner

*Primary Examiner*—F. Daniel Lopez
(74) *Attorney, Agent, or Firm*—Crowell & Moring LLP

(57) ABSTRACT

Provided are hydraulic pumps 1,2, a control valve group 15*a* connected to the pump 1 and including a bypass on/off valve 7, a control valve group 15*b* connected to the pump 2 and including a reserve-actuator-controlling, directional control valve 11, a communication line 13 communicating a most upstream side of the control valve group 15*a* with a supply line 11*a* to the reserve-actuator-controlling, directional control valve 11, a merge control valve 14 for communicating or cutting off the communication line 13, an interlocked control means for changing over the merge control valve 14 to an open position and the bypass on/off valve 7 to a closed position in association with a change-over operation of the reserve-actuator-controlling, directional control valve 11, and a selective control valve 28 capable of taking one of a state, in which the operation to change over the merge control valve 14 by the interlocked control means is feasible, and another state in which the operation to change over the merge control valve by the interlocked control means is infeasible. The control valve group 15*a*, the control valve group 15*b*, the communication line 13 and the merge control valve 14 are arranged in a housing 15 such that a change or the like in a maximum value of an operating speed of an actuator, said operating speed being controlled by the reserve directional control valve, can be achieved.

3 Claims, 8 Drawing Sheets

HYDRAULIC DRIVING DEVICE OF CIVIL ENGINEERING AND CONSTRUCTION MACHINERY

TECHNICAL FIELD

This invention relates to a hydraulic drive system for a civil engineering or construction machine such as a hydraulic excavator, which is suitable for arrangement in the civil engineering or construction machine and has a first control valve group connected to a first hydraulic pump and including plural directional control valves and a second control valve group connected to a second hydraulic pump and including plural directional control valves.

BACKGROUND ART

As conventional art of this type, there is, for example, one disclosed in JP 2642972 B2. This conventional art relates to a hydraulic circuit for a civil engineering or construction machine, and is provided with a first hydraulic pump and a second hydraulic pump.

Connected to the first hydraulic pump is a first control valve group, which is provided on a most downstream side with a bypass on/off valve having an open position and a closed position for selectively maintaining a bypass passage in or out of communication and makes up a single housing including a revolving-controlling directional control valve, an arm-controlling directional control valve, and a travel-controlling directional control valve for one of traveling motors. The individual directional control valves in this first control valve group are connected parallel to the first hydraulic pump.

Connected to the second hydraulic pump is a second control valve group, which makes up another housing including, in addition to a reserve directional control valve as an attachment-controlling directional control valve for controlling an attachment actuator for driving an attachment such as a hydraulic breaker or a hydraulic venchure, a boom-controlling directional control valve, a bucket-controlling directional control valve, and a travel-controlling directional control valve for the other traveling motor. The individual directional control valves in this second control valve group, except for the reserve directional control valve, are connected parallel to the second hydraulic pump.

Further, a communication line is arranged to communicate a delivery line from the first hydraulic pump and a supply line to the reserve directional control valve with each other. This communication line is connected at one end thereof to the housing of the first control valve group and at an opposite end thereof to the housing of the second control valve group. In other words, the communication line is arranged as an external piping outside the respective housings.

In addition, a shuttle valve is also arranged. The shuttle valve detects a pilot pressure which serves to change over the reserve directional control valve, and the shuttle valve takes it out as a control pressure for changing over the above-mentioned bypass on/off valve to the closed position.

When the reserve directional control valve is changed over in the conventional art constructed as described above, its operating pressure is applied as a control pressure to a drive portion of the bypass on/off valve in the first control valve group via the shuttle valve, and the bypass on/off valve is changed over to the closed position. Pressure oil from the first hydraulic pump is, therefore, supplied to the communication line arranged outside the two housings. This pressure oil is supplied further to the reserve directional control valve, and then to the attachment actuator controlled by the reserve directional control valve. Accordingly, the attachment actuator controlled by the reserve directional control valve is driven by the pressure oil from the first hydraulic pump rather than pressure oil from the second hydraulic pump connected to the second control valve group to which the reserve directional control valve belongs.

In the above-mentioned conventional art, the communication line through which the pressure oil from the first hydraulic pump is guided to the reserve directional control valve is a line arranged outside the housings in which the first control valve group and the second control valve group are accommodated, respectively, in other words, is an external line. The communication line, therefore, tends to become longer, leading to problems that a pressure loss tends to become large and the accuracy of control of attachment actuators tends to drop.

Further, the above-mentioned communication line is connected at the one end thereof to the housing in which the first control valve group is accommodated and at the opposite end thereof to the housing in which the second control valve group is accommodated. Oil leakage, therefore, tends to occur at both of the connected parts. Occurrence of such oil leakage leads to insufficiency in the amount of oil in the circuit and also to contamination of surrounding equipment with the oil.

Additional work is required to connect the one end of the communication line to the housing in which the first control valve group is accommodated and also to connect the opposite end of the communication line to the housing in which the second control valve group is accommodated. Accordingly, assembly work of the hydraulic circuit, that is, the hydraulic drive system becomes irksome, thereby leading to a reduction in the efficiency of the assembly work.

In the above-mentioned conventional art, it is only the pressure oil delivered from the first hydraulic pump that is supplied to the reserve directional control valve. The operating speed of the attachment actuator controlled by the reserve directional control valve is, therefore, limited in a wholesale manner to a slow speed (the first speed). It is, therefore, impossible to change the maximum value of the operating speed of the attachment actuator, for example, to set the operating speed of the attachment actuator at two speeds consisting of a slow speed and a fast speed. This has led to a problem that no improvement can be expected in the efficiency of work to be performed by the operation of the attachment actuator.

The present invention has been completed in view of the above-described circumstances of the conventional art, and a first object of the present invention is to provide a hydraulic drive system for a civil engineering or construction machine, which can shorten the length of a communication line through which a hydraulic pump, which is arranged to supply pressure oil to a control valve group in which no reserve directional control valve is included, and a reserve directional control valve are connected with each other, can prevent oil leakage from the communication line, can obviate connection work for the communication line, and can change the maximum value of the operating speed of the actuator controlled by the reserve directional control valve.

A second object of the present invention is to provide a hydraulic drive system for civil engineering or construction machine, which can change the maximum value of the operating speed of an actuator controlled by a reserve directional control valve and can also achieve good combined operation of the actuator, which is controlled by the reserve directional control valve, and an actuator which is controlled by a specific directional control valve belonging to a control valve group without the reserve directional control valve and may be applied with a load pressure higher than a load pressure too the actuator controlled by the reserve directional control valve.

DISCLOSURE OF THE INVENTION

To achieve the above-described first object, the present invention provides in a first aspect thereof a hydraulic drive system for a civil engineering or construction machine, said system being provided with a first hydraulic pump and a second hydraulic pump, a first control valve group connected to the first hydraulic pump, provided on a most downstream side thereof with a bypass on/off valve having an open position and a closed position for selectively maintaining a bypass passage in or out of communication, and a second control valve group connected to the second hydraulic pump and comprised of plural directional control valves including a reserve directional control valve, characterized in that the system is provided with a communication line communicating a most upstream side of the first control valve group with a supply line to the reserve directional control valve, a merge control valve having an open position and a closed position to selectively maintain the communication line in or out of communication, an interlocked control means for permitting an operation to change over the merge control valve to the open position and the bypass on/off valve to the closed position in association with a change-over operation of a reserve control device for changing over the reserve directional control valve, and a selective change-over means capable of selectively taking one of a state, in which the operation to change over the merge control valve to the open position by the interlocked control means is feasible, and another state in which the operation to change over the merge control valve to the open position by the interlocked control means is infeasible; and the first control valve group, the second control valve group, the communication line and the merge control valve are arranged in a single housing.

In the first aspect constructed as described above, the reserve directional control valve is changed over from a neutral position when the reserve control device is operated to operate the actuator controlled by the reserve directional control valve, for example, in a state that the selective change-over means has been operated to inhibit a change-over operation of the merge control valve to the closed position by the interlocked control means. At this time, the merge control valve is maintained in the closed position by the selective change-over means as mentioned above. Accordingly, the pressure oil from the first hydraulic pump cannot be supplied to the supply line to the reserve directional control valve via the merge control valve and the communication line, and only the pressure oil from the second hydraulic pump is supplied to the reserve directional control valve. Described specifically, only the pressure oil from the second hydraulic pump is supplied to the actuator controlled by the reserve directional control valve to operate the actuator at a relatively slow speed.

When a directional control valve belonging, for example, to the first control valve group connected to the first hydraulic pump is changed over in this state, the pressure oil from the first hydraulic pump is supplied via the directional control valve to its corresponding actuator, thereby making it possible to achieve a combined operation of the corresponding actuator and the actuator controlled by the reserve directional control valve.

When the reserve control device is operated to operate the actuator controlled by the reserve directional control valve, for example, in a state that the selective change-over means has been operated to permit a change-over operation of the merge control valve to its open position by the interlocked control means, the reserve directional control valve is changed over from the neutral position. Concurrently with this, the interlocked control means is operated to change over the merge control valve to the open position and the bypass on/off valve to the closed position, respectively. As a consequence, the pressure oil from the first hydraulic pump is guided to the supply line to the reserve directional control valve via the merge control valve and the communication line. In other words, the pressure oil from the first hydraulic pump and the pressure oil from the second hydraulic pump are both supplied to the reserve directional control valve and further to the actuator controlled by the reserve directional control valve. Therefore, the actuator controlled by the reserve directional control valve can be operated at a fast speed faster than the above-mentioned operating speed.

As has been described above, the maximum value of the operating speed of the actuator controlled by the reserve directional control valve can be selectively changed by an operation of the selective change-over means to the slow speed available by the supply of the pressure oil only from the second hydraulic pump or the fast speed available by the merging of the pressure oil from the first hydraulic pump with the pressure oil from the second hydraulic pump.

Further, the communication line through which the most upstream side of the first control valve group and the supply line to the reserve directional control valve are communicated with each other, and the merge control valve are arranged within the same single housing as the first control valve group in which the reserve directional control valve is not included and the second control valve group in which the reserve directional control valve is included. In particular, the communication line is not an external line so that the communication line is not arranged surrounding the housing. Accordingly, the length of the communication line can be set extremely short.

The communication line is arranged within the housing, and a connection part at the most upstream side of the first control valve group, to which connection part the communication line is connected at the one end thereof, and a connection part of the supply line to the reserve directional control valve, to which connection part the communication line is connected at the opposite end thereof, are both located within the housing. It is, therefor, possible to prevent leakage of oil supplied to the communication line, in other words, leakage of oil from the housing.

Moreover, the connection part at the most upstream side of the first control valve group, to which connection part the communication line is connected at the one end thereof, and the connection part of the supply line to the reserve directional control valve, to which connection part the communication line is connected at the opposite end thereof, can be both formed upon fabrication of the housing. No additional line connecting work is therefore needed for the communication line.

To achieve the first object, the present invention also provides in a second aspect thereof a hydraulic drive system as described above in connection with the first aspect, wherein the reserve directional control valve comprises a hydraulically-operated pilot valve, the reserve control device comprises a pilot-operated control device for outputting a pilot pressure to change over the reserve directional control valve, and the merge control valve and the bypass on/off valve comprise hydraulically-operated pilot valves, respectively, the interlocked control means includes a shuttle valve, which can detect apilot pressure outputted from the reserve control device and can output the pilot pressure as a pressure signal for changing over the merge control valve to the open position and the bypass on/off valve to the closed position, and a pilot line communicating the shuttle valve with respective drive portions of the merge control valve and the bypass on/off valve, and the selective change-over means includes a selective control valve arranged in a part of the pilot line, which communicates the shuttle valve with the drive portion of the merge control valve, and capable of selectively taking one of a first state in which a pilot pressure outputted from the shuttle valve can be supplied to the drive portion of the merge control valve and a second state in which a pilot pressure outputted from the shuttle valve cannot be supplied to the drive portion of the merge control valve.

In the second aspect constructed as described above, the reserve directional control valve is changed over from the neutral position by a pilot pressure outputted from a reserve control device when the reserve control device is operated to operate the actuator controlled by the reserve directional control valve, for example, in a state that the selective control valve has been changed over to inhibit a change-over operation of the merge control valve to the open position by the pilot pressure outputted from the reserve control device. At this time, the merge control valve is maintained in the closed position by the selective control valve as mentioned above. Accordingly, the pressure oil from the first hydraulic pump cannot be supplied to the supply line to the reserve directional control valve via the merge control valve and the communication line, and only the pressure oil from the second hydraulic pump is supplied to the reserve directional control valve. Described specifically, only the pressure oil from the second hydraulic pump is supplied to the actuator controlled by the reserve directional control valve to operate the actuator at a relatively slow speed.

When a directional control valve belonging, for example, to the first control valve group connected to the first hydraulic pump is changed over in this state, the pressure oil from the first hydraulic pump is supplied via the directional control valve to its corresponding actuator, thereby making it possible to achieve a combined operation of the corresponding actuator and the actuator controlled by the reserve directional control valve.

When the reserve control device is operated to operate the actuator controlled by the reserve directional control valve, for example, in a state that the selective control valve has been changed over to permit a change-over operation of the merge control valve to its open position by a pilot pressure outputted from the reserve control device, the reserve directional control valve is changed over from the neutral position by the pilot pressure outputted from the reserve control device. Concurrently with this, the pilot pressure outputted from the reserve control device is applied to the drive portion of the merge control valve and the drive portion of the bypass on/off valve, respectively, via the shuttle valve, the selective control valve and the pilot line, and the merge control valve and the bypass on/off valve are changed over to the open position and the closed position, respectively. As a consequence, the pressure oil from the first hydraulic pump is guided to the supply line to the reserve directional control valve via the merge control valve and the communication line. In other words, the pressure oil from the first hydraulic pump and the pressure oil from the second hydraulic pump are both supplied to the reserve directional control valve and further to the actuator controlled by the reserve directional control valve. Therefore, the actuator controlled by the reserve directional control valve can be operated at a fast speed faster than the above-mentioned operating speed.

As has been described above, the maximum value of the operating speed of the actuator controlled by the reserve directional control valve can be selectively changed by an operation of the selective change-over means to the slow speed available by the supply of the pressure oil only from the second hydraulic pump or the fast speed available by the merging of the pressure oil from the first hydraulic pump with the pressure oil from the second hydraulic pump.

To achieve the first object, the present invention also provides in a third aspect thereof a hydraulic drive system as described above in connection with the second aspect, wherein the selective control valve comprises a solenoid valve and the selective change-over means includes a selector switch for outputting an electrical signal to selectively actuate the selective control valve such that the selective control valve is maintained in one of the first state and the second state.

In the third aspect constructed as described above, the selective control valve can be maintained, depending upon an operation of the selector switch, in either the first state in which a change-over operation of the merge control valve to the open position by a pilot pressure outputted from the reserve control device is feasible or the second state in which a change-over operation of the merge control valve to the open position by a pilot pressure outputted from the reserve control device is infeasible.

To achieve the first object, the present invention also provides in a fourth aspect thereof a hydraulic drive system as described above in connection with the first aspect, wherein the selective change-over means and the bypass on/off valve comprise hydraulically-operated pilot valves, respectively, the interlocked control means includes a predetermined hydraulic pressure source and a pilot line for guiding a pilot pressure, which has been outputted from the predetermined hydraulic pressure source, as a pressure signal to change over the merge control valve to the open position and at the same time, as a pressure signal to change over the bypass on/off valve to the closed position, and the selective change-over means includes a selective control valve arranged in a part of the pilot line, which communicates the predetermined hydraulic pressure source with the drive portion of the merge control valve, and capable of selectively taking one of a first state in which a pilot pressure outputted from the predetermined hydraulic pressure source can be supplied to the drive portion of the merge control valve and a second state in which a pilot pressure outputted from the predetermined hydraulic pressure source cannot be supplied to the drive portion of the merge control valve, and an operation detecting means for detecting an operation of the reserve control device to output an electrical signal such that the selective control valve is selectively operated to remain in one of the first state and the second state.

In the fourth aspect constructed as described above, an operation of the reserve control device to operate the actuator controlled by the reserve directional control valve can change over the reserve directional control valve from the neutral position provided that the selective control valve is set to inhibit a change-over operation of the merge control valve to the open position by a pilot pressure outputted from the predetermined hydraulic pressure source, for example, when the operation detecting means detects an operation of the reserve control device. At this time, the merge control valve is maintained in the closed position by the selective control valve as mentioned above. Accordingly, the pressure oil from the first hydraulic pump cannot be supplied to the supply line to the reserve directional control valve via the merge control valve and the communication line, and only the pressure oil from the second hydraulic pump is supplied to the reserve directional control valve. Described specifically, only the pressure oil from the second hydraulic pump is supplied to the actuator controlled by the reserve directional control valve to operate the actuator at a relatively slow speed.

When a directional control valve belonging, for example, to the first control valve group connected to the first hydraulic pump is changed over in this state, the pressure oil from the first hydraulic pump is supplied via the directional control valve to its corresponding actuator, thereby making it possible to achieve a combined operation of the corresponding actuator and the actuator controlled by the reserve directional control valve.

Provided that the selective control valve has been set to permit a change-over operation of the merge control valve to the open position by a pilot pressure outputted from the predetermined hydraulic pressure source, for example, when the operation detecting means detects an operation of the reserve control device, an operation of the reserve control device to operate the actuator controlled by the reserve directional control valve results in a change-over of the reserve directional control valve from the neutral position. Concurrently with this, the operation of the reserve control device is detected by the operation detecting means, a pilot pressure outputted from predetermined hydraulic source is applied to the drive portion of the merge control valve and the drive portion of the bypass on/off valve, respectively, via the selective control valve and the pilot line, and the merge control valve and the bypass on/off valve are changed over to the open position and the closed position, respectively. As a consequence, the pressure oil from the first hydraulic pump is guided to the supply line to the reserve directional control valve via the merge control valve and the communication line. In other words, the pressure oil from the first hydraulic pump and the pressure oil from the second hydraulic pump are both supplied to the reserve directional control valve and further to the actuator controlled by the reserve directional control valve. Therefore, the actuator controlled by the reserve directional control valve can be operated at a fast speed faster than the above-mentioned operating speed.

As has been described above, the maximum value of the operating speed of the actuator controlled by the reserve directional control valve can be selectively changed to the slow speed available by the supply of the pressure oil only from the second hydraulic pump or the fast speed available by the merging of the pressure oil from the first hydraulic pump with the pressure oil from the second hydraulic pump.

To achieve the first object, the present invention also provides in a fifth aspect thereof a hydraulic drive system as described above in connection with the first aspect, wherein the hydraulic drive system further comprises a merge control valve control means for controlling the merge control valve such that the merge control valve is changed over to the closed position in response to an operation of a desired directional control valve included in the first control valve group.

In the fifth aspect constructed as described above, when a predetermined directional control valve in the first control valve group in which the reserve directional control valve is not included is operated, for example, in a state that the selective change-over means has been operated and changed over into a state where a change-over operation of the merge control valve to the open position by the interlocked control means is feasible, the reserve control device has been operated and the reserve directional control valve has been changed over and the actuator controlled by the reserve directional control valve is operating at a fast speed by the pressure oil supplied and merged from the first hydraulic pump and the second hydraulic pump, the merge control valve control means is operated to change over the merge control valve from the open position to the closed position. As a consequence, the pressure oil from the first hydraulic pressure is blocked by the merge control valve and is no longer supplied to the reserve directional control valve. Namely, the pressure oil from the first hydraulic pump is supplied to the predetermined directional control valve, and only the pressure oil from the second hydraulic pump is supplied to the reserve directional control valve. Therefore, the actuator controlled by the predetermined directional control valve operates at a speed commensurate with a flow rate at which the pressure oil is supplied from the first hydraulic pump, while the actuator controlled by the reserve directional control valve changes to a slow speed commensurate with a flow rate at which the pressure oil is supplied from the second hydraulic pump.

As has been described above, it is possible to perform a combined operation of the actuator controlled by the reserve directional control valve and the actuator controlled by the predetermined directional control valve, although the operating speed of the actuator controlled by the reserve directional control valve changes from a fast sped to a slow speed.

To achieve the first object, the present invention also provides in a sixth aspect thereof a hydraulic drive system as described above in connection with the first aspect, wherein the predetermined directional control valve comprises a hydraulically-operated pilot valve, a predetermined directional control valve control device for changing over the predetermined directional control valve comprises a pilot control device for outputting a pilot pressure, the reserve directional control valve comprises a hydraulically-operated pilot valve, the reserve control device comprises a pilot control device for outputting a pilot pressure to change over the reserve directional control valve, and the merge control valve and the bypass on/off valve comprises hydraulically-operated pilot valves, respectively, the interlocked control means includes a first shuttle valve, which can detect a pilot pressure outputted from the reserve control device and can output the pilot pressure as a pressure signal for changing over the merge control valve to the open position and the bypass on/off valve to the closed position, and a first pilot line communicating the first shuttle valve with respective drive portions of the merge control valve and the bypass on/off valve, the selective change-over means includes a selective control valve arranged in a part of the first pilot line, which communicates the first shuttle valve with the drive portion of the merge control valve, and capable of selectively taking one of a first state in which a pilot pressure outputted from the first shuttle valve can be supplied to the drive portion of the merge control valve and a second state in which a pilot pressure outputted from the first shuttle valve cannot be supplied to the drive portion of the merge control valve, and the merge control valve control means includes a second shuttle valve, which can detect a pilot pressure outputted from the predetermined directional control valve control device and can output the pilot pressure as a pressure signal for changing over the merge control valve, and a second pilot line communicating the second shuttle valve with a drive portion of the merge control valve.

In the sixth aspect constructed as described above, the reserve directional control valve is changed over from the neutral position by a pilot pressure outputted from a reserve control device when the reserve control device is operated to operate the actuator controlled by the reserve directional control valve, for example, in a state that the selective control valve has been changed over to inhibit a change-over operation of the merge control valve to the open position by the pilot pressure outputted from the reserve control device. At this time, the merge control valve is maintained in the closed position by the selective control valve as mentioned above. Accordingly, the pressure oil from the first hydraulic pump cannot be supplied to the supply line to the reserve directional control valve via the merge control valve and the communication line, and only the pressure oil from the second hydraulic pump is supplied to the reserve directional control valve. Described specifically, only the pressure oil from the second hydraulic pump is supplied to the actuator controlled by the reserve directional control valve to operate the actuator at a relatively slow speed.

When a directional control valve belonging, for example, to the first control valve group connected to the first hydraulic pump is changed over in this state, the pressure oil from the first hydraulic pump is supplied via the directional control valve to its corresponding actuator, thereby making it possible to achieve a combined operation of the corresponding actuator and the actuator controlled by the reserve directional control valve.

When the reserve control device is operated to operate the actuator controlled by the reserve directional control valve, for example, in a state that the selective control valve has been changed over to permit a change-over operation of the merge control valve to its open position by a pilot pressure outputted from the reserve control device, the reserve directional control valve is changed over from the neutral position by the pilot pressure outputted from the reserve control device. Concurrently with this, the pilot pressure outputted from the reserve control device is applied to the drive portion of the merge control valve and the drive portion of the bypass on/off valve, respectively, via the first shuttle valve, the selective control valve and the first pilot line, and the merge control valve and the bypass on/off valve are changed over to the open position and the closed position, respectively. As a consequence, the pressure oil from the first hydraulic pump is guided to the supply line to the reserve directional control valve via the merge control valve and the communication line. In other words, the pressure oil from the first hydraulic pump and the pressure oil from the second hydraulic pump are both supplied to the reserve directional control valve and further to the actuator controlled by the reserve directional control valve. Therefore, the actuator controlled by the reserve directional control valve can be operated at a fast speed faster than the above-mentioned operating speed.

When the predetermined directional control valve control device is operated, for example, in a state that the pressure oil from the first hydraulic pump and the pressure oil from the second hydraulic pump are both supplied to the reserve directional control valve, the predetermined directional control valve belonging to the first control valve group in which the reserve directional control valve is not included is changed over from the neutral position by a pilot pressure outputted from the predetermined directional control valve control device. Concurrently with this, a pilot pressure outputted from the predetermined directional control valve control device is detected by the second shuttle valve and is applied to the drive portion of the merge control valve via the second pilot line. The merge control valve is, therefore, changed over from the open position to the closed position. As a consequence, the pressure oil from the first hydraulic pressure is blocked by the merge control valve and is no longer supplied to the reserve directional control valve. Namely, the pressure oil from the first hydraulic pump is supplied to the predetermined directional control valve, and only the pressure oil from the second hydraulic pump is supplied to the reserve directional control valve.

As has been described above, when the predetermined directional control valve is operated, the actuator controlled by the predetermined directional control valve can be operated by the pressure oil from the first hydraulic pump, and the maximum value of the operating speed of the actuator controlled by the reserve directional control valve is set at the slow speed which depends solely upon the pressure oil from the second hydraulic pump.

To achieve the first object, the present invention also provides in a seventh aspect thereof a hydraulic drive system as described above in connection with the sixth aspect, wherein the first shuttle valve and the second shuttle valve are accommodated within a shuttle block composed of a single housing.

According to the seventh aspect constructed as described above, a group of shuttle valves can be arranged together.

To achieve the second object, on the other hand, the present invention also provides in an eighth aspect thereof a hydraulic drive system for a civil engineering or construction machine, said system being provided with a first hydraulic pump and a second hydraulic pump, a first control valve group connected to the first hydraulic pump, provided on a most downstream side thereof with a bypass on/off valve having an open position and a closed position for selectively maintaining a bypass passage in or out of communication, and a second control valve group connected to the second hydraulic pump and comprised of plural directional control valves including a reserve directional control valve, characterized in that the system is provided with a communication line communicating a most upstream side of the first control valve group with a supply line to the reserve directional control valve, a merge control valve having an open position and a closed position to selectively maintain the communication line in or out of communication, an interlocked control means for permitting an operation to change over the merge control valve to the open position and the bypass on/off valve to the closed position in association with a change-over operation of a reserve control device for changing over the reserve directional control valve, a selective change-over means capable of selectively taking one of a state, in which the operation to change over the merge control valve to the open position by the interlocked control means is feasible, and another state in which the operation to change over the merge control valve to the open position by the interlocked control means is infeasible, and a valve opening area control means for controlling drive of the merge control valve such that, when a specific directional control valve included in the first control valve group for controlling drive of an actuator to which a load pressure higher than a load pressure to an actuator controlled by the reserve directional control valve may be applied is operated concurrently with a change-over operation of the reserve directional control valve by the reserve control device, a valve opening area of the merge control valve is changed to a predetermined small valve opening area.

In the eighth aspect constructed as described above, the reserve directional control valve is changed over from a neutral position when the reserve control device is operated to operate the actuator controlled by the reserve directional control valve, for example, in a state that the selective change-over means has been operated to permit a change-over operation of the merge control valve to the open position by the interlocked control means. Concurrently with this, the interlocked control means is operated to change over the merge control valve and the bypass on/off valve to the open position and the closed position, respectively. Accordingly, the pressure oil from the first hydraulic pump is guided to the supply line to the reserve directional control valve via the merge control valve and the communication line. Namely, the pressure oil from the first hydraulic pump and the pressure oil from the second hydraulic pump are both supplied to the reserve directional control valve and further to the actuator controlled by the reserve directional control valve. The actuator controlled by the reserve directional control valve can be operated at a fast speed accordingly.

When, as mentioned above, the specific directional control valve included in the first control valve group is operated and changed over either after the reserve control device has been operated and the reserve directional control valve has been changed over from the neutral position or concurrently with a change-over operation of the reserve directional control valve from the neutral position in a state that the selective change-over means has been operated to permit a change-over operation of the merge control valve to the open position by the interlocked control means, the valve opening area control means operates such that the valve opening area of the merge control valve is controlled to the predetermined small valve open area.

As a result, the merge control valve is controlled such that the supply of the pressure oil from the first hydraulic pump to the reserve directional control valve via the merge control valve is reduced, and therefore, a sufficient portion of the pressure oil from the first hydraulic pump can be supplied to the specific directional control valve. Accordingly, the actuator controlled by the specific directional control valve, in other words, the actuator to which a load pressure higher than that to be applied to the actuator controlled by the reserve directional control valve may be applied can be driven together with the actuator controlled by the reserve directional control valve, thereby making it possible to achieve a good combined operation of these actuators.

To achieve the second object, the present invention also provides in a ninth aspect thereof a hydraulic drive system as described above in connection with the eighth aspect, wherein the reserve directional control valve comprises a hydraulically-operated pilot valve, the reserve control device comprises a pilot-operated control device for outputting a pilot pressure to change over the reserve directional control valve, and the merge control valve and the bypass on/off valve comprise hydraulically-operated pilot valves, respectively, the interlocked control means includes a shuttle valve, which can detect a pilot pressure outputted from the reserve control device and can output the pilot pressure as a pressure signal for changing over the merge control valve to the open position and the bypass on/off valve to the closed position, and a pilot line communicating the shuttle valve with respective drive portions of the merge control valve and the bypass on/off valve, and the selective change-over means includes a selective control valve arranged in a part of the pilot line, which communicates the shuttle valve with the drive portion of the merge control valve, and capable of selectively taking one of a first state in which a pilot pressure outputted from the shuttle valve can be supplied to the drive portion of the merge control valve and a second state in which a pilot pressure outputted from the shuttle valve cannot be supplied to the drive portion of the merge control valve.

To achieve the second object, the present invention also provides in a tenth aspect thereof a hydraulic drive system as described above in connection with the ninth aspect, wherein the selective control valve comprises a solenoid valve; and the valve opening area control means includes a specific operation detecting means for detecting an operation of the specific directional control valve, which is included in the first control valve group, and outputting an electrical signal, and a controller for performing a predetermined computation based on the electrical signal outputted from the specific operation detecting means and outputting a control signal, which is commensurate with results of the computation, as a signal for driving the selective control valve.

In the tenth aspect constructed as described above, when an operation of the specific directional control valve included in the first control valve group is detected by the specific operation detecting means, an electrical signal is outputted to the controller from the specific operation detecting means. The controller outputs a control signal, which is commensurate with the electrical signal, to the drive portion of the selective control valve, and accordingly, the shuttle valve is restricted such that a pilot pressure to be supplied from the shuttle valve to the drive portion of the merge control valve becomes lower. As a consequence, the merge control valve is controlled such that its valve opening area is reduced to a predetermined small valve opening area.

BEDT MODES FOR CARRYING OUT THE INVENTION

Embodiments of the hydraulic drive system according to the present invention for the civil engineering or construction machine will hereinafter be described based on the drawings.

Figure 1:
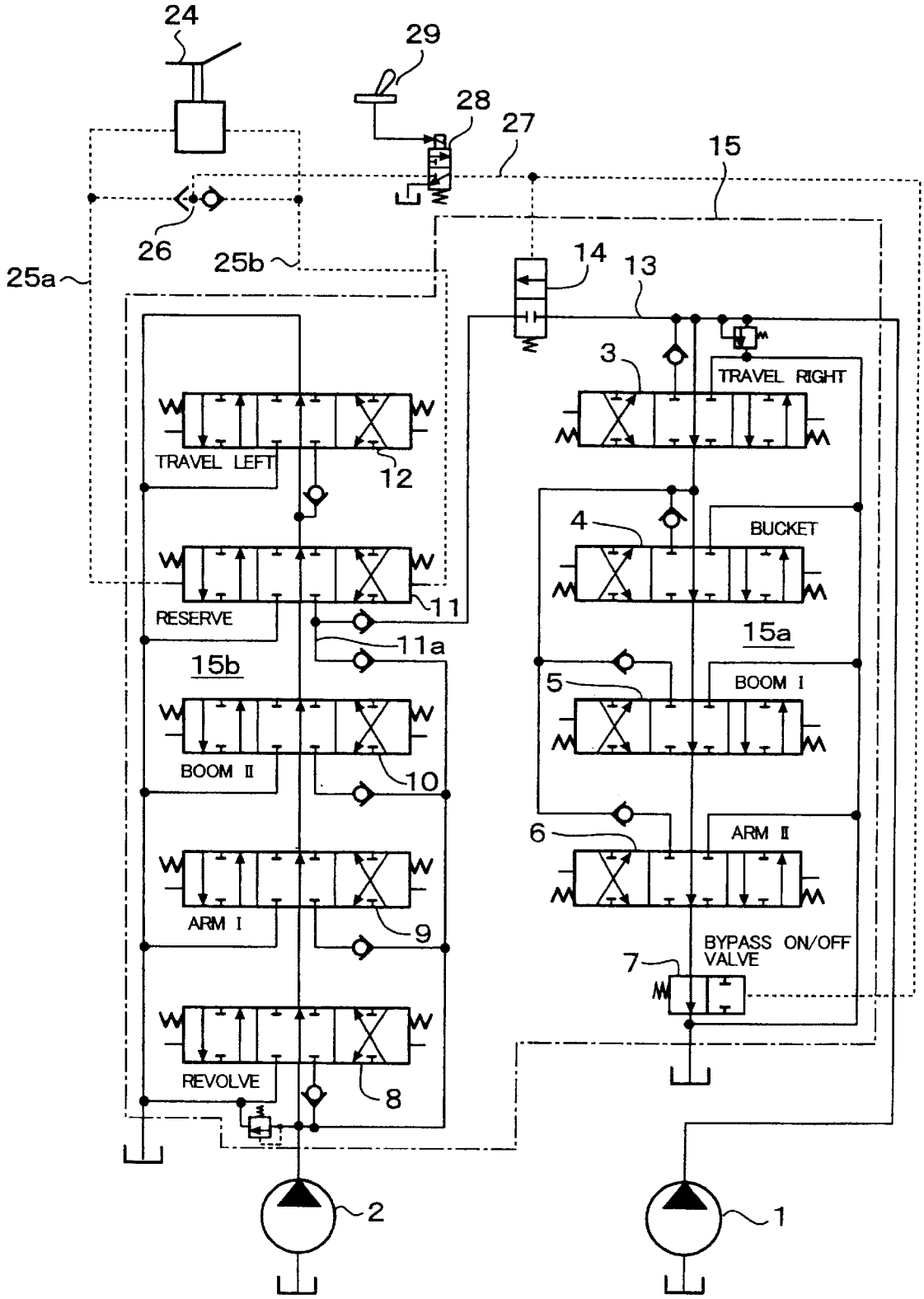
FIG. 1 is a hydraulic circuit diagram showing the construction of a first embodiment of the hydraulic drive system according to the present invention for a civil engineering or construction machine.
Figure 2:
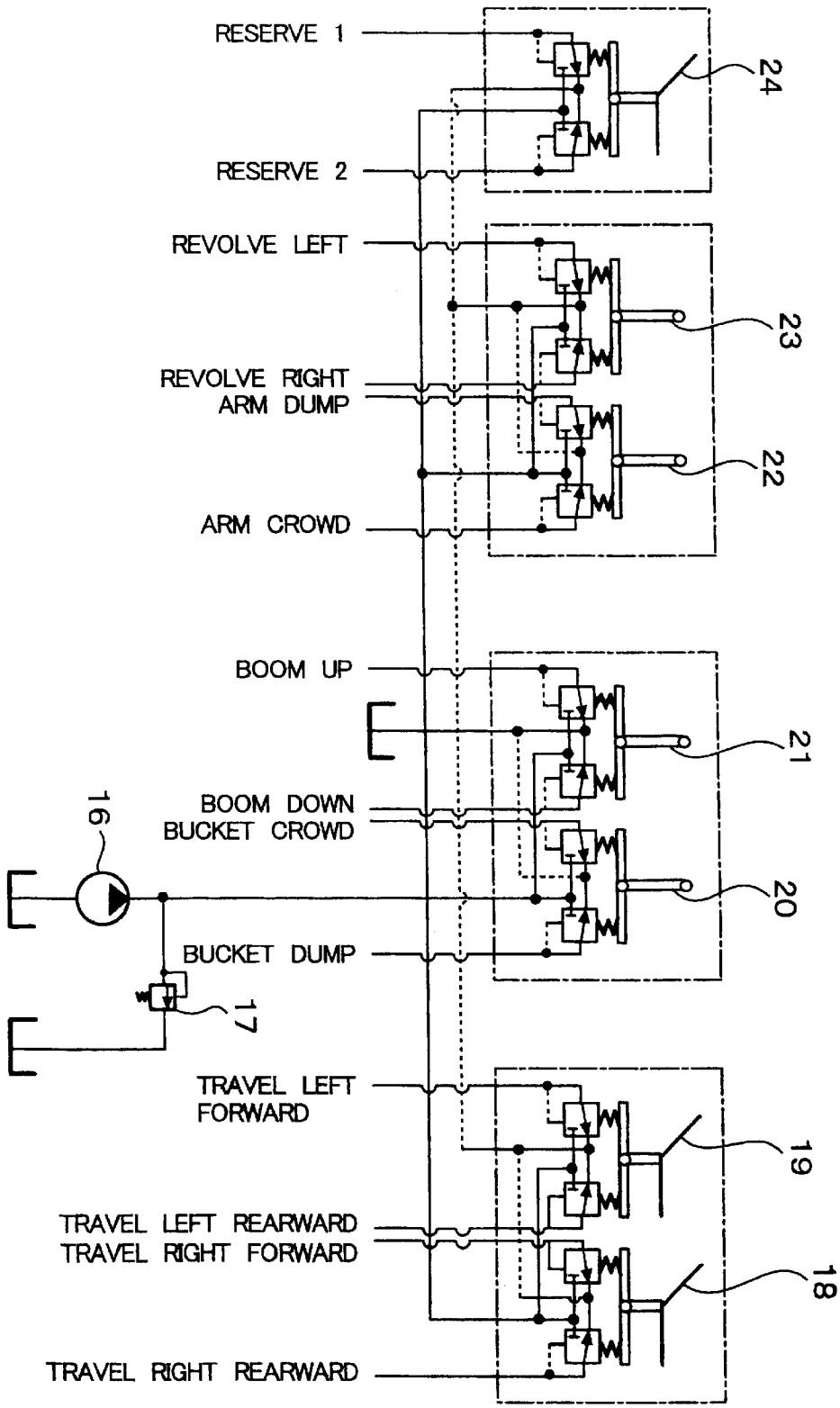
FIG. 2 is a diagram illustrating a pilot control device arranged in the first embodiment shown in FIG. 1.

FIGS. 1 and 2 are explanatory diagrams showing the hydraulic drive system according to the first embodiment of the present invention for the civil engineering or construction machine, in which FIG. 1 is the hydraulic circuit diagram showing the construction of the first embodiment and FIG. 2 is the diagram illustrating the pilot control device arranged in the first embodiment shown in FIG. 1. Incidentally, this first embodiment corresponds to the first to third aspects described above.

The first embodiment depicted in FIGS. 1 and 2 is suited for arrangement, for example, in a hydraulic excavator, and is provided with a first hydraulic pump 1, a second hydraulic pump 2, a first control valve group 15*a* connected to the first hydraulic pump 1, and a second control valve group 15*b* connected to the second hydraulic pump 2.

The first control valve group 15*a* includes, on a most downstream side thereof, a bypass on/off valve 7 having an open position and a closed position for selectively maintaining a bypass line either in or out of communication, and also includes plural directional control valves such as a bucket-controlling, directional control valve 4 for controlling drive of a bucket cylinder, a boom-controlling, first directional control valve 5 for controlling drive of a boom cylinder and a arm-controlling, second directional control valve 6 for controlling drive of an arm cylinder, in addition to a travel-controlling, right directional control valve 3 arranged on a most upstream side for controlling one of travel motors.

The second control valve group 15*b* includes, in addition to a revolving-controlling, directional control valve 8 arranged on a most upstream side thereof for controlling drive of a revolving motor, an arm-controlling, first directional control valve 9 for controlling drive of the above-mentioned arm cylinder, a boom-controlling, second directional control valve 10 for controlling drive of the above-mentioned boom cylinder, the reserve-actuator-controlling, directional control valve 11 for controlling drive of an attachment actuator, and a travel-controlling, left directional control valve 12 for controlling drive of the other traveling motor.

The above-mentioned, directional control valves 3–6, 8–12 comprise, for example, hydraulically-operated pilot valves, respectively, and are change-over controlled by the corresponding pilot control devices depicted in FIG. 2. Described specifically, the above-mentioned travel-controlling, right directional control valve 3 is controlled by a right travel motor control device 18, the travel-controlling, left directional control valve 12 is controlled by a left travel motor control device 19, the bucket-controlling, directional control valve 4 is controlled by a bucket control motor 20, the boom-controlling, first directional control valve 5 and the boom-controlling, second directional control valve 10 are controlled by a boom control device 21, the arm-controlling, first directional control valve 9 and the arm-controlling, second directional control valve 10 are controlled by an arm control device 22, the revolving-controlling, directional control valve 8 is controlled by a revolving control device 23, and the reserve-actuator-controlling, directional control valve 11 is controlled by the reserve actuator control device 24. Each of these pilot control devices outputs an output pressure of a pilot pump 16, said output pressure being specified by a pilot pressure relief valve 17 in accordance with its stroke, as a pilot pressure for changing over the corresponding directional control valve.

Also arranged are a communication line 13 communicating the most upstream side of the first control valve group 15*a* with a supply line 11*a* to the reserve-actuator-controlling, directional control valve 11 and a merge control valve 14 having an open position and a closed position for selectively maintaining the communication line 13 in or out of communication. Arranged further is an interlocked control means which can change over the merge control valve 14 to the open position and the bypass on/off valve 7 to the closed position, respectively, in association with the change-over operation of the reserve actuator control device 24 to change over the reserve-actuator-controlling, directional control valve 11. This interlocked control means includes a shuttle valve 26 and apilot line 27 communicating the shuttle valve 26 with respective drive portions of the merge control valve 14 and bypass on/off valve 7. The shuttle valve 26 can detect a pilot pressure, which is outputted, for example, from the reserve actuator control device 24, via a control line 25*a* or control line 25*b* through which the pilot pressure is guided to change over the reserve-actuator-controlling, directional control valve 11, and can output as a pressure signal for changing over the merge control valve 14 to the open position and the bypass on/off valve 7 to the closed position, respectively.

Arranged still further is a selective change-over means for selectively changing over to one of a state in which the above-mentioned change-over operation of the merge control valve 14 to the open position by the interlocked control means is feasible and another state in which this change-over operation is infeasible. This selective change-over means comprises a selective control valve 28 and a selector switch 29. The selective control valve 28 is arranged in the pilot line 27, and serves to selectively change over to one of a first state, in which a pilot pressure outputted from the shuttle valve 26 can be supplied to the drive portion of the merge control valve 14, and a second state in which the pilot pressure cannot be supplied to the drive portion of the merge control valve 14. The selector switch 29 outputs an electrical signal to selectively operate the selective control valve 28 such that it is maintained in one of the above-mentioned first state and second state.

This first embodiment is also constructed such that the first control valve group 15*a* including the bypass on/off valve 7, the second control valve group 15*b* including the reserve-actuator-controlling, directional control valve 11, the communication line 13 and the merge control valve 14, all of which have been mentioned above, are arranged in a single housing 15.

This first embodiment is operated as will be described hereinafter.

With the selector switch 29 not operated, for example, the selective control valve 28 is maintained in the closed position which is a lower changed-over position as viewed in FIG. 1. During this time, the pilot line 27 is maintained out of communication. Described specifically, the connections between the shuttle valve 26 and the respective drive portions of the merge control valve 14 and bypass on/off valve 7 are cut off. It is, therefore, impossible to change over the merge control valve 14 to the open position, which is an upper changed-over position as viewed in FIG. 1, by a pilot pressure outputted from the reserve actuator control device 24.

When the reserve actuator control device 24 is operated in this state to operate the actuator controlled by the reserve-actuator controlling, directional control valve 11, a pilot pressure out putted from the reserve actuator control device 24 is guided to the control line 25*a* or 25*b* so that the reserve-actuator-controlling, directional control valve 11 is changed over from a neutral position. At this time, the merge control valve 14 is maintained in the closed position by the selective control valve 28 as mentioned above. Therefore, pressure oil from the first hydraulic pump 1 cannot be supplied to the supply line 11*a* to the reserve-actuator-controlling, directional control valve 11 via the merge control valve 14 and the communication line 13, and only pressure oil from the second hydraulic pump 2 is supplied to the reserve-actuator-controlling, directional control valve 11. Namely, only the pressure oil from the second hydraulic pump 2 is supplied to the actuator controlled by the reserve-actuator-controlling, directional control valve 11, and the actuator can be operated at a relatively slow speed.

When a directional control valve belonging to the first control valve group 15*a* connected to the first hydraulic pump 1, for example, the boom-controlling, first directional control valve 5 is changed over in this state, the pressure oil from the first hydraulic pump 1 is supplied to the boom cylinder via the boom-controlling, first directional control valve 5, thereby making it possible to perform a combined operation of this boom cylinder and the actuator controlled by the reserve-actuator-controlling, directional control valve 11.

When the selector switch 29 is operated, the selective control valve 28 is changed over to the open position which is the upper changed-over position as viewed in FIG. 1. At this time, the pilot line 27 is communicated. Described specifically, the shuttle valve 26 is brought into communication with the respective drive portions of the merge control valve 14 and bypass on/off valve 7. This makes it possible to change over the merge control valve 14 to the open position, which is the upper changed-over position as viewed in FIG. 1, by a pilot pressure outputted from the reserve actuator control device 24.

When the reserve actuator control device 24 is operated in this state with a view to operating the actuator controlled by the reserve-actuator-controlling directional control valve 11, the reserve-actuator-controlling directional control valve 11 is changed over from the neutral position by a pilot pressure outputted from the reserve actuator control device 24. Concurrently with this, the pilot pressure outputted from the reserve actuator control device 24 is applied to the drive portion of the merge control valve 14 and the drive portion of the bypass on/off valve 7 via the shuttle valve 26, the selective control valve 28 and the pilot line 27, so that the merge control valve 14 and the bypass on/off valve 7 are changed over to the open position and the closed position, respectively. As a result, the pressure oil from the first hydraulic pump 1 is guided to the supply line 11*a* to the reserve-actuator-controlling, directional control valve 11 via the merge control valve 14 and the communication line 13. Described specifically, the pressure oil from the first hydraulic pump 1 and the pressure oil from the second hydraulic pump 2 are both supplied to the reserve-actuator-controlling, directional control valve 11, and further to the actuator controlled by the reserve-actuator-controlling, directional control valve 11. Accordingly, the actuator controlled by the reserve-actuator-controlling, directional control valve 11 can be operated at a fast speed faster than the above-mentioned operating speed.

As has been described above, a change-over operation of the selective control valve 28 by an operation of the selector switch 29 makes it possible to selectively change the maximum value of the operating speed of the actuator, which is controlled by the reserve-actuator-controlling, directional control valve 11, either to a slow speed available by the supply of only the pressure oil from the second hydraulic pump 2 or to a fast speed available by the merging of the pressure oil from the first hydraulic pump 1 with the pressure oil from the second hydraulic pump 2.

The communication line 13, through which the most upstream side of the first control valve group 15*a* and the supply line 11*a* to the reserve-actuator-controlling, directional control valve 11 are communicated with each other, and the merge control valve 14 are arranged together with the first control valve group 15*a*, which does not include the reserve-actuator-controlling, directional control valve 11, and the second control valve group 15*b* , which includes the reserve-actuator-controlling, directional control valve 11, in the single housing 15. In particular, the communication line 13 is not an external line so that it is not arranged surrounding the housing 15. Owing to these features, the length of the communication line 13 can be set extremely short.

Further, the communication line 13 is arranged within the housing 15 , and a connection part at the most upstream side of the first control valve group 15*a*, to which connection part the communication line 13 is connected at an end thereof, and a connection part of the supply line 11*a* to the reserve-actuator-controlling, directional control valve 11, to which connection part the communication line 13 is connected at an opposite end thereof, are both located within the housing 15. It is, therefor, possible to prevent leakage of oil supplied to the communication line 13, in other words, leakage of oil from the housing 15.

Moreover, the connection part at the most upstream side of the first control valve group 15, to which connection part the communication line 13 is connected at the one end thereof, and the connection part of the supply line 11*a* to the reserve-actuator-controlling, directional control valve 11, to which connection part the communication line 13 is connected at the opposite end thereof, can be both formed upon fabrication of the housing 15. No additional line connecting work is therefore needed for the communication line 13.

According to the first embodiment constructed as described above, a combined operation of the actuator, which is controlled by the reserve-actuator-controlling, directional control valve 11 connected to the second hydraulic pump 2, the actuator for the boom cylinder or the like, which is controlled by the boom-controlling, first directional control valve connected to the first hydraulic pump 1, can be achieved while surely retaining their own independence.

As the maximum value of the operating speed of the actuator controlled by the reserve-actuator-controlling, directional control valve 11 can be changed, the actuator can be controlled, for example, at two speeds consisting of a slow speed and a fast speed, and control to the fast speed makes it possible to improve the efficiency of work by an attachment or the like, said work being performed by the operation of the actuator.

Since the length of the communication line 13 through which the first hydraulic pump 1 and the reserve-actuator-controlling, directional control valve 11 are connected with each other can be shortened, a pressure loss through the communication line 13 can be reduced, thereby making it possible to control with high accuracy the actuator controlled by the reserve-actuator-controlling, directional control valve 11.

Further, the successful prevention of leakage of oil supplied to the communication line 13 makes it possible to decrease occurrence of insufficiency in the amount of oil in the circuit and also to prevent contamination of surrounding equipment by such oil leakage.

Moreover, the successful obviation of line connecting work for the communication line 13 makes it possible to reduce the irksomeness of assembly work of the hydraulic drive system and hence to improve the efficiency of the assembly work.

Figure 3:
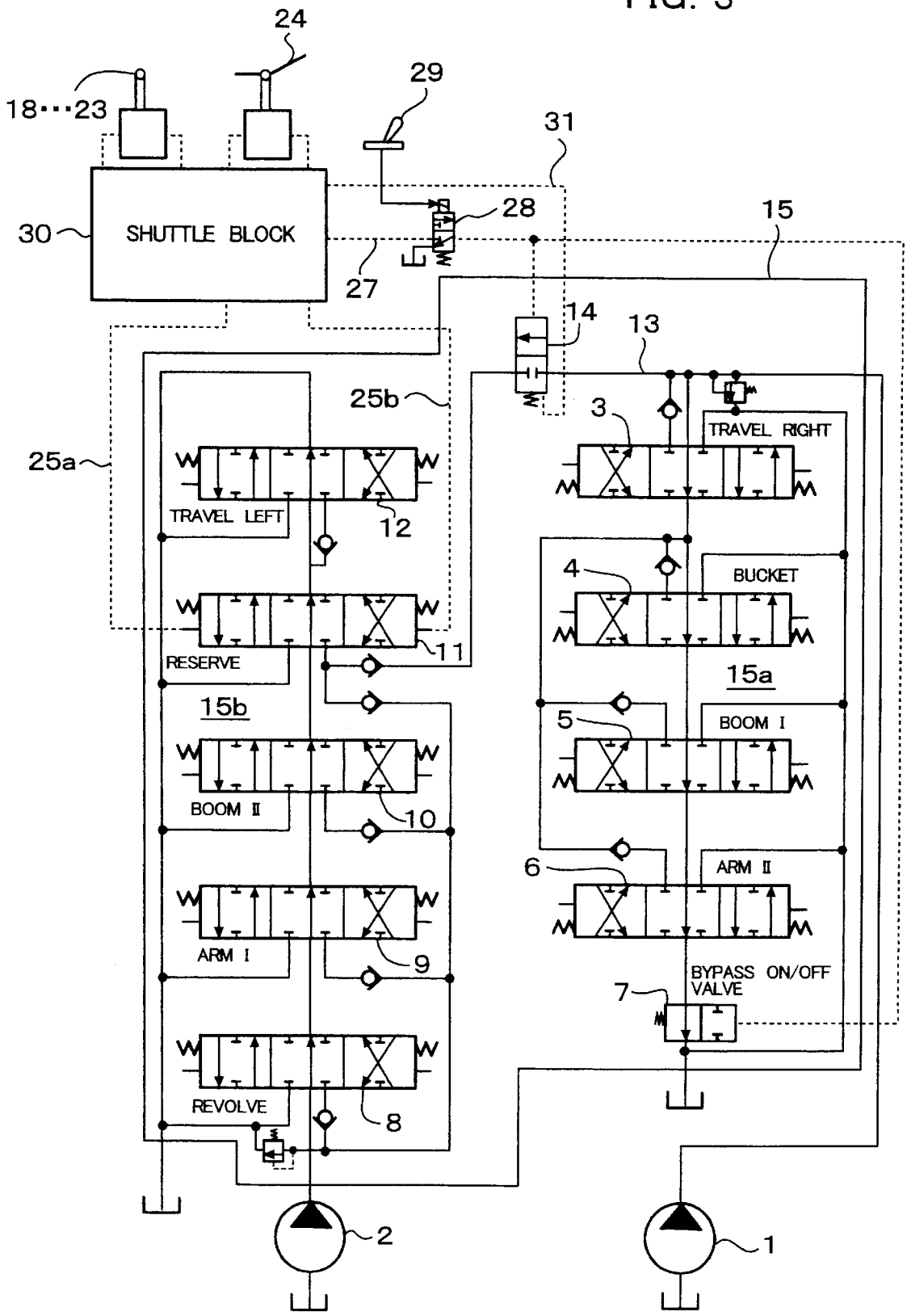
FIG. 3 is a hydraulic circuit diagram showing the construction of a second embodiment of the present invention.
Figure 4:
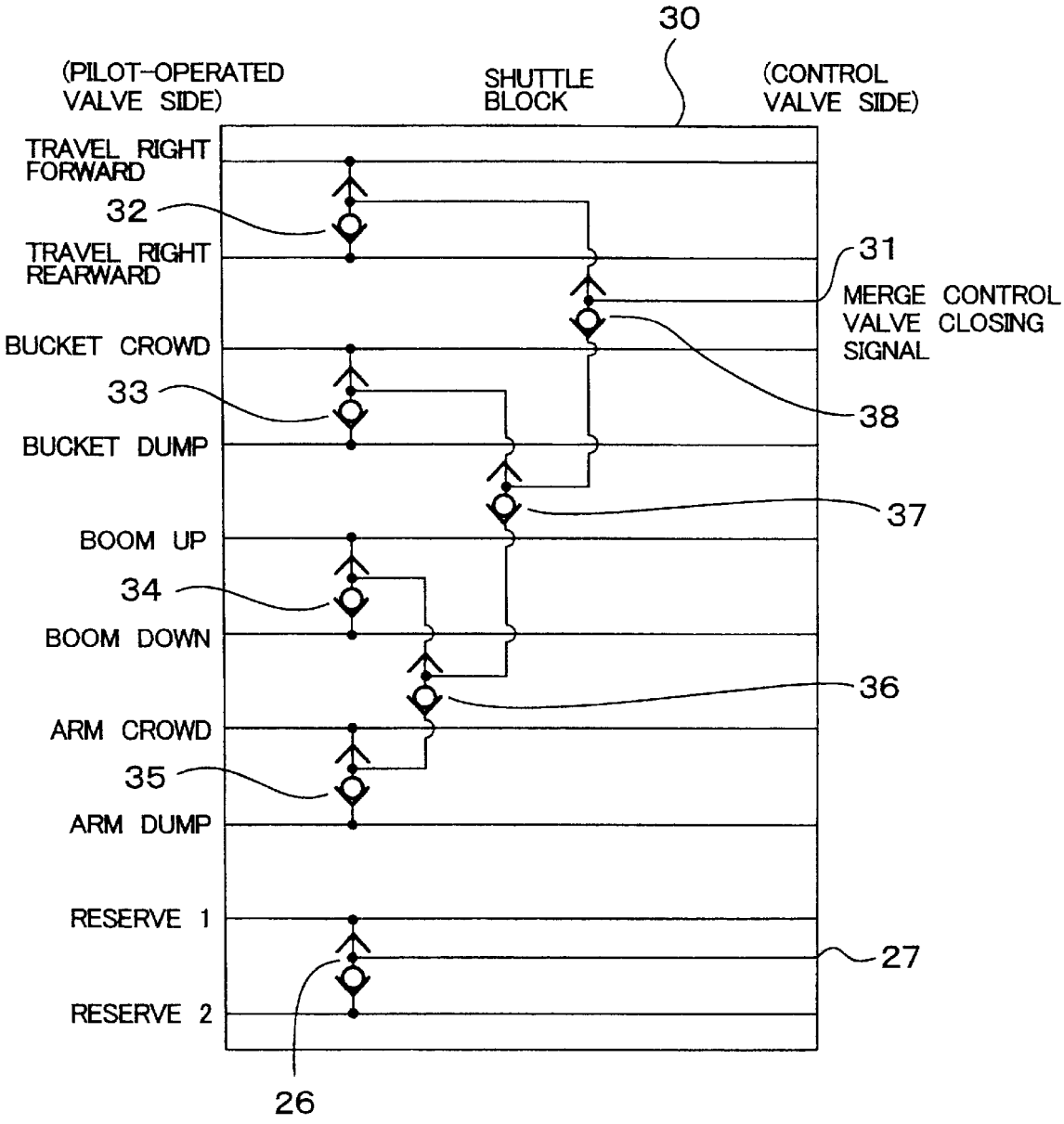
FIG. 4 is a diagram illustrating a shuttle block arranged in the second embodiment shown in FIG. 3.

FIGS. 3 and 4 are explanatory diagrams showing the hydraulic drive system according to the second embodiment of the present invention for the civil engineering or construction machine, in which FIG. 3 is the hydraulic circuit diagram showing the construction of the second embodiment and FIG. 4 is the diagram illustrating the shuttle block arranged in the second embodiment shown in FIG. 3. Incidentally, this second embodiment corresponds to the first, second, third, fifth, sixth and seventh aspects described above.

The second embodiment depicted in FIGS. 3 and 4 is also provided with an interlocked control means which can change over the merge control valve 14 to the open position and the bypass on/off valve 7 to the closed position, respectively, in association with the change-over operation of the reserve actuator control device 24 to change over the reserve-actuator-controlling, directional control valve 11. This interlocked control means includes a first shuttle valve, that is, a shuttle valve 26 and a first pilot line connecting the shuttle valve 26 with the respective drive portions of the merge control valve 14 and bypass on/off valve 7. The first shuttle valve can detect a pilot pressure outputted from the reserve actuator control device 24 and can output as a pressure signal for changing over the merge control valve 14 to the open position and the bypass on/off valve 7 to the closed position, respectively.

Arranged still further is a selective change-over means for selectively changing over to one of a state in which the above-mentioned change-over operation of the merge control valve 14 to the open position by the interlocked control means is feasible and another state in which this change-over operation is infeasible. This selective change-over means includes a selective control valve 28, which is arranged in the above-mentioned first pilot line, that is, the pilot line 27 and selectively changes over to one of a first state, in which a pilot pressure outputted from the above-mentioned first shuttle valve, that is, the shuttle valve 26 can be supplied to the drive portion of the merge control valve 14, and a second state in which the pilot pressure cannot be supplied to the drive portion of the merge control valve 14.

In particular, this second embodiment is provided with a merge control valve control means for performing control such that the merge control valve 14 is changed over to the closed position upon operation of a predetermined directional control valve included in the first control valve group 15*a* connected to the first hydraulic pump 1, for example, the bucket-controlling, directional control valve 4, the boom-controlling, first directional control valve 5 or the arm-controlling, second directional control valve 6. This merge control valve control means is constructed to include second shuttle valves 33,34,35,36,37,38 depicted in FIG. 4 and a second pilot line 31. The second shuttle valves 33,34,35,36, 37,38 detect, for example, pilot pressures outputted from control devices for the corresponding directional control valves, such as the above-mentioned bucket control device 20, boom control device 21 and arm control device 22, and output them as control signals for controlling the merge control valve 14. The second pilot line 31 communicates these second shuttle valves 33–38 to the drive portion of the merge control valve 14, said drive portion serving to change over the merge control valve to the closed position, specifically to a drive portion forming a spring compartment.

Incidentally, designated at numeral 32 in FIG. 4 is a shuttle valve for detecting a pilot pressure which is outputted upon operation of the right travel motor control device 18 or left travel motor control device 19. This shuttle valve 32 is arranged, for example, in communication with the second shuttle valve 38.

The above-mentioned first shuttle valve, namely, the shuttle valve 26, the second shuttle valves 33–38 and the shuttle valve 32 are accommodated within a shuttle block 30 formed of a single housing.

The remaining construction is similar to the corresponding construction of the above-mentioned first embodiment shown in FIGS. 1 and 2.

This second embodiment is operated as will be described hereinafter.

With the selector switch 29 not operated, for example, the selective control valve 28 is maintained in the closed position which is a lower changed-over position as viewed in FIG. 3. During this time, the pilot line 27 is maintained out of communication. Described specifically, the connections between the shuttle valve 26 and the respective drive portions of the merge control valve 14 and bypass on/off valve 7 are cut off. It is, therefore, impossible to change over the merge control valve 14 to the open position, which is an upper changed-over position as viewed in FIG. 3, by a pilot pressure outputted from the reserve actuator control device 24.

When the reserve actuator control device 24 is operated in this state to operate the actuator controlled by the reserve-actuator controlling, directional control valve 11, the reserve-actuator-controlling, directional control valve 11 is changed over from a neutral position by a pilot pressure outputted from the reserve actuator control device 24. At this time, the merge control valve 14 is maintained in the closed position by the selective control valve 28 as mentioned above. Therefore, the pressure oil from the first hydraulic pump 1 cannot be supplied to the supply line 11*a* to the reserve-actuator-controlling, directional control valve 11 via the merge control valve 14 and the communication line 13, and only the pressure oil from the second hydraulic pump is supplied to the reserve-actuator-controlling, directional control valve 11. Namely, only the pressure oil from the second hydraulic pump 2 is supplied to the actuator controlled by the reserve-actuator-controlling, directional control valve 11, and the actuator can be operated at a relatively slow speed.

When a directional control valve belonging to the first control valve group 15*a* connected to the first hydraulic pump 1, for example, the boom-controlling, first directional control valve 5 is changed over in this state, the pressure oil from the first hydraulic pump 1 is supplied to the boom cylinder via the boom-controlling, first directional control valve 5, thereby making it possible to perform a combined operation of this boom cylinder and the actuator controlled by the reserve-actuator-controlling, directional control valve 11.

When the selector switch 29 is operated, the selective control valve 28 is changed over to the open position which is the upper changed-over position as viewed in FIG. 3. At this time, the pilot line 27 is communicated. Described specifically, the shuttle valve 26 is brought into communication with the respective drive portions of the merge control valve 14 and bypass on/off valve 7. This makes it possible to change over the merge control valve 14 to the open position, which is the upper changed-over position as viewed in FIG. 3, by a pilot pressure outputted from the reserve actuator control device 24. by the reserve-actuator-controlling directional control valve 11, the reserve-actuator-controlling directional control valve 11 is changed over from the neutral position by a pilot pressure outputted from the reserve actuator control device 24. Concurrently with this, the pilot pressure outputted from the reserve actuator control device 24 is applied to the drive portion of the merge control valve 14, specifically to a drive portion not forming the spring compartment and the drive portion of the bypass on/off valve 7 via the first shuttle valve, namely, the shuttle valve 26, the selective control valve 28 and the first pilot line, namely, the pilot line 27, so that the merge control valve 14 and the bypass on/off valve 7 are changed over to the open position and the closed position, respectively. As a result, the pressure oil from the first hydraulic pump 1 is guided to the supply line 11*a* to the reserve-actuator-controlling, directional control valve 11 via the merge control valve 14 and the communication line 13. Described specifically, the pressure oil from the first hydraulic pump 1 and the pressure oil from the second hydraulic pump 2 are both supplied to the reserve-actuator-controlling, directional control valve 11, and further to the actuator controlled by the reserve-actuator-con trolling, directional control valve 11. Accordingly, the actuator controlled by the reserve-actuator-controlling, directional control valve 11 can be operated at a fast speed faster than the above-mentioned operating speed.

When a control device for a predetermined directional control valve, for example, the boom control device 21 is operated, for example, in a state that the pressure oil from the first hydraulic pump 1 and the pressure oil from the second hydraulic pump 2 are both being supplied to the reserve-actuator-controlling, directional control valve 11, the boom-controlling, first directional control valve 5 belonging to the first control valve group 15*a* in which the reserve-actuator-controlling, directional control valve 11 is not included is changed over from the neutral position by a pilot pressure outputted from the boom control device 21. Concurrently with this, the pilot pressure outputted from the boom control device 21 is detected at the second shuttle valves 34, 36, 37, 38, and is applied via the second pilot line 31 to the drive portion forming the spring compartment of the merge control valve 14. As a result, the merge control valve 14 is changed over from the open position to the closed position. Accordingly, the pressure oil from the first hydraulic pump 1 is blocked by the merge control valve 14 and is no longer supplied to the reserve-actuator-controlling, directional control valve 11. Namely, the pressure oil from the first hydraulic pump 1 is supplied to the boom-controlling, first directional control valve 5, and only the pressure oil from the second hydraulic pump 2 is supplied to the reserve-actuator-controlling, directional control valve 11.

As has been described above, when the boom-controlling, first directional control valve 5 is operated, the boom cylinder controlled by the boom-controlling, first directional control valve 5 can be operated by the pressure oil from the first hydraulic pump 1 and further, the maximum value of the operating speed of the actuator controlled by the reserve-actuator-controlling, directional control valve 11 is controlled to a slow speed which relies upon only the pressure oil from the second hydraulic pump 2.

The second embodiment constructed as described above brings about similar advantageous effects as the above-mentioned first embodiment. Moreover, especially when a control device for a predetermined directional control valve such as the boom control device 21 is operated in the state that the pressure oil from the first hydraulic pump 1 and the pressure oil from the first hydraulic pump 2 are both being supplied to the reserve-actuator-controlling, directional control valve 11, the pressure oil from the first hydraulic pump 1 and the pressure oil from the second hydraulic pump 2 are supplied to predetermined directional control valve such as the boom-controlling, first directional control valve 5 and the reserve-actuator-controlling, directional control valve 11, respectively, without needing an operation of the selector switch 29, thereby permitting an automatic transfer to a combined operation of the actuator controlled by the predetermined directional control valve and the actuator controlled by the reserve-actuator-controlling, directional control valve 11. Excellent operability is thus obtained.

In this second embodiment, the shuttle valve 26 as the first shuttle valve, the second shuttle valves 33–38 and the shuttle valve 32 are accommodated within the shuttle block 30 which forms a single housing. A group of shuttle valves can be arranged together, thereby realizing the construction of the whole system into a compact structure.

Incidentally, the above-mentioned first embodiment and second embodiment are each constructed such that the selective control switch 28 is changed over responsive to an operation of the selector switch 29 and also such that the merge control valve 14 and the bypass on/off valve 7 are changed over responsive to a pilot pressure produced by an operation of the reserve actuator control device 24 for the control of the reserve-actuator-controlling, directional control valve 11. It is, however, to be noted that the present invention is limited neither to the construction that the selector switch 29 is arranged as described above nor to the construction that the merge control valve 14 and the bypass on/off valve 7 are changed over responsive to the pilot pressure produced by the operation of the reserve actuator control device 24 for the control of the reserve-actuator-controlling, directional control valve 11.

Although not illustrated in the drawings, the present invention may be constructed, for example, such that the merge control valve 14 and the bypass on/off valve 7 are formed of hydraulically-operated pilot valves, respectively, as in the above-mentioned embodiments; the interlocked control means includes a predetermined hydraulic pressure source, such as a pilot pump, and a pilot line for guiding a pilot pressure, which has been outputted from the predetermined hydraulic pressure source, as a pressure signal for changing over the merge control valve 14 to the open position and at the same time, as a pressure signal for changing over the bypass on/off valve 7 to the closed position, without interposition of any shuttle valve; and the selective change-over means is arranged in the part of a pilot line, through which the predetermined hydraulic pressure source and the drive portion of the merge control valve 14 are communicated with each other, and includes the selective control valve 28, which is composed of a solenoid valve for selectively changing over to one of a first state in which the above-mentioned pilot pressure outputted from the predetermined hydraulic source can be supplied to the drive portion of the merge control valve 14 and a second state in which the pilot pressure cannot be supplied to the drive portion of the merge control valve 14, and an operation detecting means for detecting an operation of the reserve actuator control device 24 and outputting an electrical signal to selectively operate the selective control valve 28 such that said selective control valve 28 is maintained in one of the above-mentioned first state and second state. The remaining construction may be made like the corresponding construction in the above-mentioned first embodiment. This construction corresponds to the fourth aspect described above.

In the hydraulic drive system constructed as described above, an operation of the reserve actuator control device 24 with a view to operating the actuator controlled by the reserve-actuator controlling, directional control valve 11 changes over the reserve-actuator-controlling, directional control valve 11 from the neutral position, provided that the selective control valve 28 is set to inhibit a change-over operation of the merge control valve 14 to the open position by a pilot pressure, which is outputted from the predetermined hydraulic pressure source, when the operation detecting means detects an operation of the reserve actuator control device 24, for example. At this time, the merge control valve 14 is maintained in the closed position by the selective control valve 28 as mentioned above. Therefore, the pressure oil from the first hydraulic pump 1 cannot be supplied to the supply line 11*a* to the reserve-actuator-controlling, directional control valve 11 via the merge control valve 14 and the communication line 13, and only the pressure oil from the second hydraulic pump 2 is supplied to the reserve-actuator-controlling, directional control valve 11. Namely, only the pressure oil from the second hydraulic pump 2 is supplied to the actuator controlled by the reserve-actuator-controlling, directional control valve 11, and the actuator can be operated at a relatively slow speed.

When a directional control valve belonging, for example, to the first control valve group 15*a* connected to the first hydraulic pump 1 is changed over in this state, the pressure oil from the first hydraulic pump 1 is supplied to the corresponding actuator via the directional control valve, thereby making it possible to perform a combined operation of the corresponding actuator and the actuator controlled by the reserve-actuator-controlling, directional control valve 11.

An operation of the reserve actuator control device 24 with a view to operating the actuator controlled by the reserve-actuator-controlling, directional control valve 11 changes over the reserve-actuator-controlling, directional control valve 11 from the neutral position, provided that the selective control valve 28 is set to permit a change-over operation of the merge control valve 11 to the open position by a pilot pressure, which is outputted from the predetermined hydraulic pressure source, when the operation detecting means detects an operation of the reserve actuator control device 24, for example. Concurrently with this, the operation of the reserve actuator control device 24 is detected by the operation detection means, the pilot pressure outputted from the predetermined hydraulic pressure source is applied to the drive portion of the merge control valve 14 and the drive portion of the bypass on/off valve 7 via the selective control valve 28 and the pilot line 27, so that the merge control valve 14 and the bypass on/off valve 7 are changed over to the open position and the closed position, respectively. As a result, the pressure oil from the first hydraulic pump 1 is guided to the supply line 11*a* to the reserve-actuator-controlling, directional control valve 11 via the merge control valve 14 and the communication line 13. Described specifically, the pressure oil from the first hydraulic pump 1 and the pressure oil from the second hydraulic pump 2 are both supplied to the reserve-actuator-controlling, directional control valve 11, and further to the actuator controlled by the reserve-actuator-controlling, directional control valve 11. Accordingly, the actuator controlled by the reserve-actuator-controlling, directional control valve 11 can be operated at a fast speed faster than the above-mentioned operating speed.

In the hydraulic drive system constructed as described above, it is also possible to selectively change the maximum value of the operating speed of the actuator, which is controlled by the reserve-actuator-controlling, directional control valve 11, either to a slow speed available by the supply of only the pressure oil from the second hydraulic pump 2 or to a fast speed available by the merging of the pressure oil from the first hydraulic pump 1 with the pressure oil from the second hydraulic pump 2. The second embodiment can, therefore, bring about similar effects as the above-mentioned first embodiment.

Figure 5:
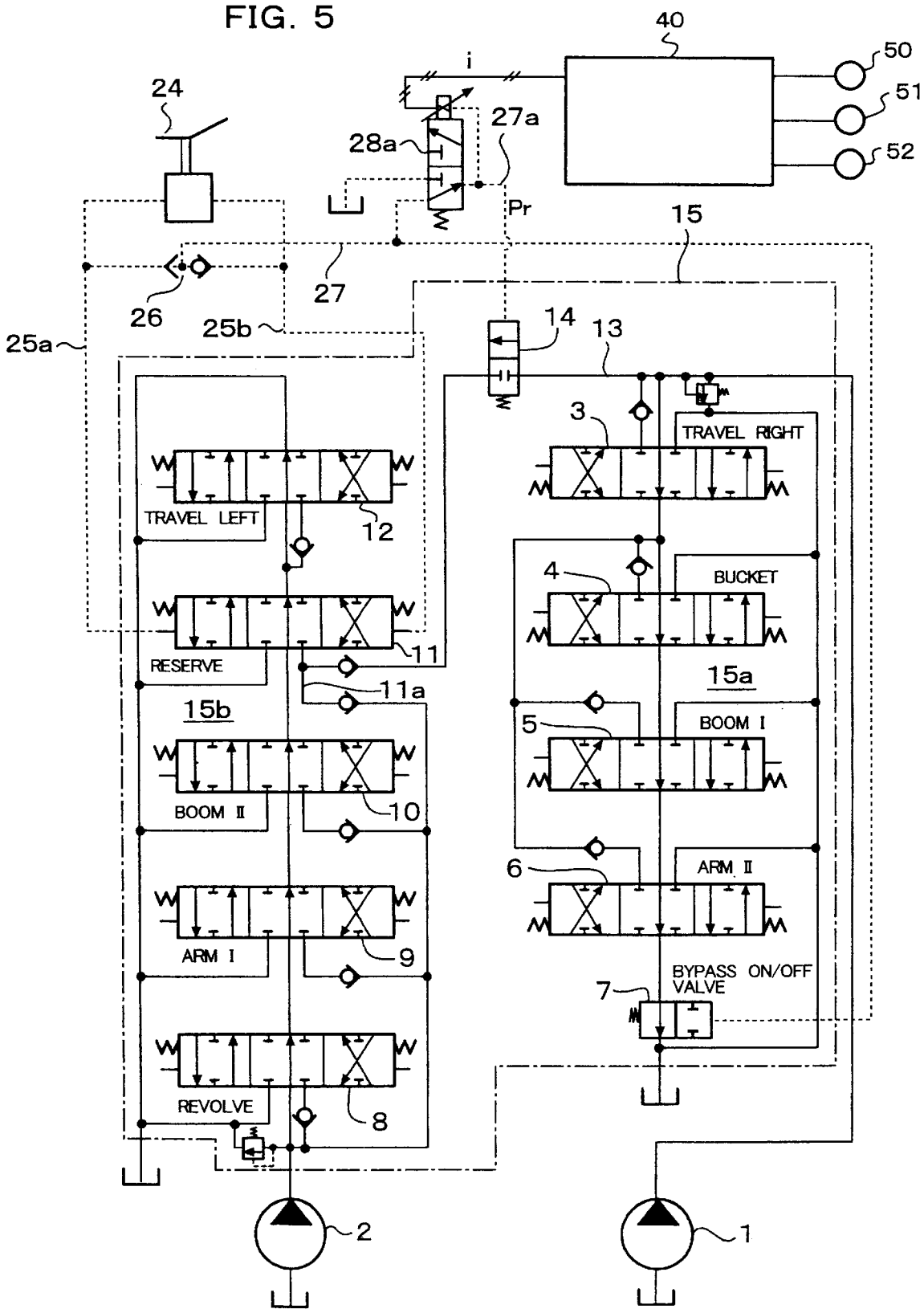
FIG. 5 is a hydraulic circuit diagram showing the construction of a third embodiment of the present invention.
Figure 6:
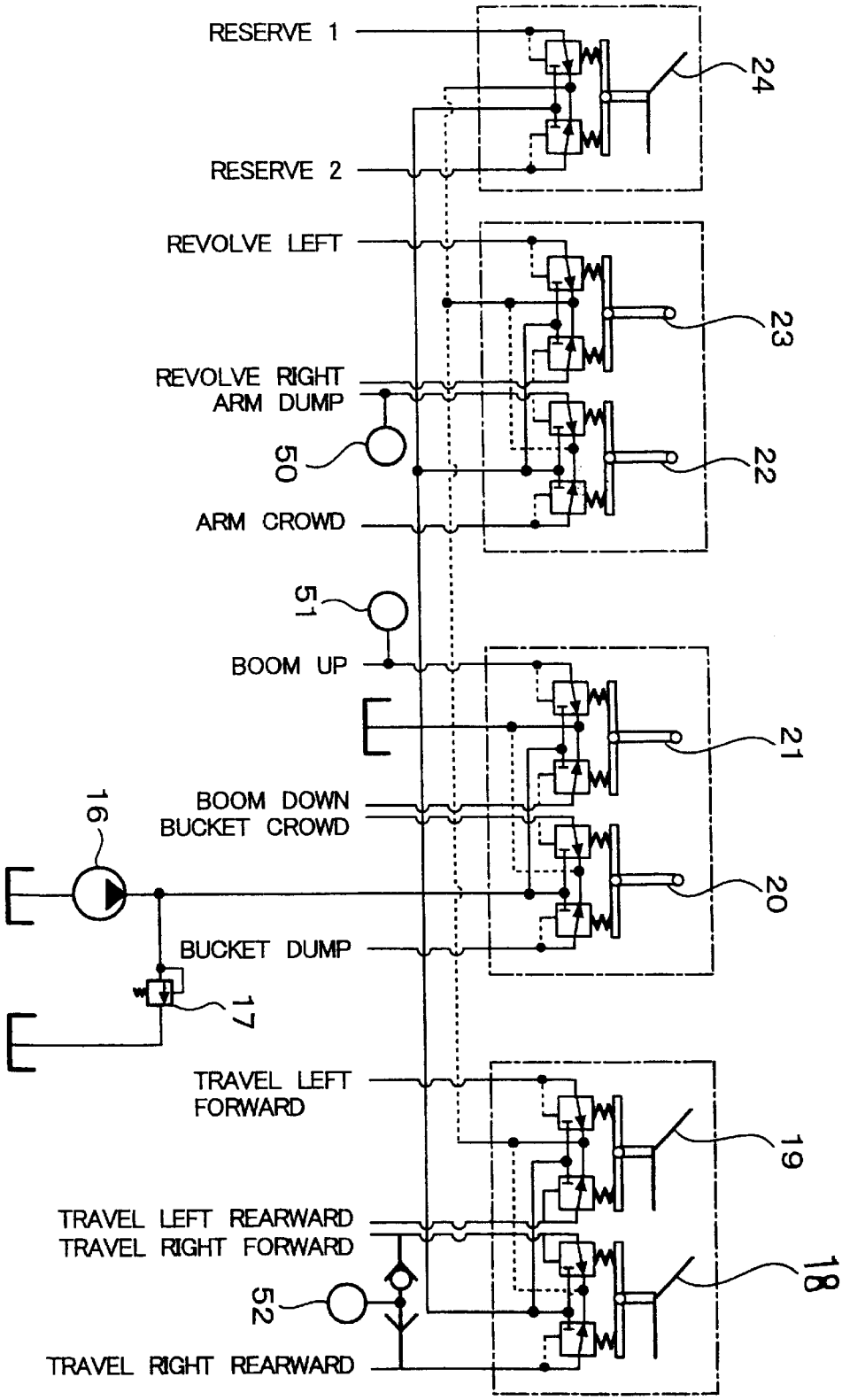
FIG. 6 is a diagram illustrating a pilot control device arranged in the third embodiment shown in FIG. 5.
Figure 7:
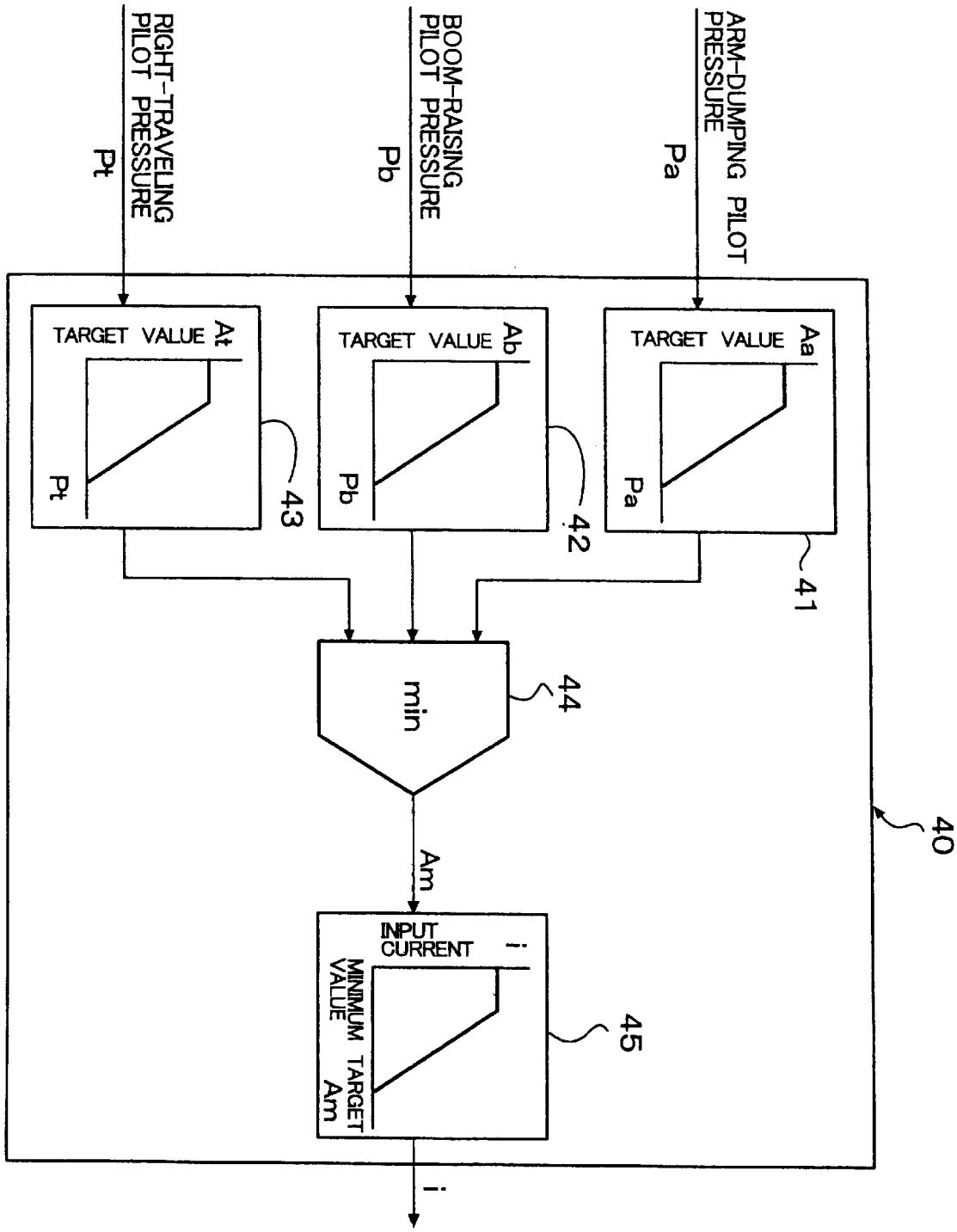
FIG. 7 is a diagram illustrating a controller arranged in the third embodiment shown in FIG. 5.

FIGS. 5, 6 and 7 are diagrams for explaining the hydraulic drive system according to the third embodiment of the present invention for the civil engineering or construction machine, in which FIG. 5 is the hydraulic circuit diagram showing the construction of the third embodiment of the present invention, FIG. 6 is the diagram illustrating the pilot control device arranged in the third embodiment shown in FIG. 5, and FIG. 7 is a diagram depicting the construction of the controller arranged in the third embodiment shown in FIG. 5. Incidentally, this third embodiment corresponds to the eighth, ninth and tenth aspects described above.

In this third embodiment, a branch line 27*a* is arranged on the pilot line 27 connected to the shuttle valve 26 which constitutes the interlocked control means for permitting changing over the merge control valve 14 and the bypass on/off valve 7 to the open position and the closed position, respectively. Arranged in this branch line 27*a* is a selective control valve 28*a*, which constitutes a selective change-over means for selectively changing over to one of a state, in which the above-mentioned change-over operation of the merge control valve 14 to the open position by the interlocked control means is feasible, and another state, in which the change-over operation is infeasible, and is composed of a solenoid valve, for example.

In particular, the third embodiment is provided with a valve opening area control means for controlling drive of the merge control valve 14 such that the valve opening area of the merge control valve 14 is changed to a predetermined valve opening area smaller than the valve opening area in its fully open position when, concurrently with a change-over operation of the reserve-actuator-controlling, directional control valve 11 by the reserve actuator control device 24, a directional control valve for controlling drive of an actuator, which is included in the first control valve group 15*a* communicated to the first hydraulic pump 1 and may be applied with a load pressure higher than a load pressure to the actuator controlled by the reserve-actuator-controlling, directional control valve 11, for example, the boom-controlling, first directional control valve 5 for controlling drive of the unillustrated boom cylinder is operated, the arm-controlling, second directional control valve 6 for controlling drive of the unillustrated arm cylinder is operated or the travel-controlling, right directional control valve 3 for controlling drive of the unillustrated right drive motor is operated.

This valve opening area control means includes a specific operation detecting means for detecting, for example, an operation of the boom-controlling, first directional control valve 5, the arm-controlling, second directional control valve 6 or the travel-controlling, right directional control valve 7 and outputting an electrical signal, and a controller 40 for performing a predetermined computation based on the above-mentioned electrical signal outputted from the specific operation detecting means and outputting a control signal, which is commensurate with results of the computation, as a signal for driving the selective control valve 28*a*.

The above-mentioned specific operation detecting means includes a first pressure sensor 50 for detecting a pilot pressure, for example, upon operation of the arm control device 22 to have the unillustrated arm cylinder extended, namely, an arm-dumping pilot pressure Pa and outputting as an electrical signal to the controller 40, a second pressure sensor 51 for detecting a pilot pressure upon operation of the boom control device 21 to have the unillustrated boom cylinder extended, namely, a boom-raising pilot pressure Pb and outputting it as an electrical signal to the controller 40, and a third pressure sensor 52 for detecting a pilot pressure upon operation of the right travel motor control device 18 to have the unillustrated right travel motor driven, namely, a right travel pilot pressure Pt and outputting it as an electrical signal to the controller 40.

On the other hand, the above-mentioned controller 40 includes, as shown in FIG. 7, an arm-dumping function generator unit 41, a boom-raising function generator unit 42, a right-travel-motor-driving function generator unit 43, a minimum target value selector unit 44, and a control signal generator unit 45. The arm-dumping function generator unit 41 generates a target value Aa, which gradually becomes smaller as the value of the electrical signal outputted from the first pressure sensor 50, namely, the arm-dumping pilot pressure Pa increases. The boom-raising function generator unit 42 generates a target value Ab, which gradually becomes smaller as the value of the electrical signal outputted from the second pressure sensor 51, namely, the boom-raising pilot pressure Pb increases. The right-travel-motor-driving function generator unit 43 generates a target value At, which gradually becomes smaller as the value of the electrical signal outputted from the third pressure sensor 52, namely, the right travel pilot pressure Pt increases. The minimum target value selector unit 44 selects the smallest value of the target values Aa,Ab,At outputted from these function generator units 41,42,43 and outputs it as a minimum target value Am. The control signal generator unit 45 generates an input current i which gradually becomes larger as the minimum target value Am outputted from the minimum target value selector unit 44 decreases, that is, a control signal for controlling drive of the selective control valve 28*a*.

The remaining fundamental construction is similar to the corresponding construction in the above-mentioned first embodiment shown in FIG. 1.

The third embodiment constructed as described above is operated as will be described hereinafter.

As is illustrated in FIG. 5, the selective control valve 28*a* is maintained in an open position, which is a lower changed-over position as viewed in FIG. 5, when the input current i, namely, the control signal is not applied to the drive portion of the selective control valve 28*a*. At this time, the branch line 27*a* of the pilot line 27 is communicated. Described specifically, the shuttle valve 26 is connected to the drive portion of the merge control valve 14. This makes it possible to change over the merge control valve 14 to the open position, which is the upper changed-over position as viewed in FIG. 5, by a pilot pressure outputted from the reserve actuator control device 24.

When the reserve actuator control device 24 is operated in this state with a view to operating the actuator controlled by the reserve-actuator-controlling directional control valve 11, a pilot pressure outputted from the reserve actuator control device 24 is guided to the control line 25*a* or 25*b*, and the reserve-actuator-controlling directional control valve 11 is changed over from the neutral position. At this time, the above-mentioned pilot pressure is drawn out from the shuttle valve 26, is guided to the branch line 27*a* of the pilot line 27, and is applied as an output pressure Pr from the selective control valve 28*a* to the drive portion of the merge control valve. As a result, the merge control valve 14 is changed over to the open position which is the upper changed-over position as viewed in FIG. 5. Further, by the pilot pressure guided to the pilot line 27, the bypass on/off valve 7 is changed over to the closed position. Accordingly, the pressure oil from the first hydraulic pump 1 is guided to the supply line 11*a* to the reserve-actuator-controlling, directional control valve 11 via the merge control valve 14 and the communication line 13. Described specifically, the pressure oil from the first hydraulic pump 1 and the pressure oil from the second hydraulic pump 2 are both supplied to the reserve-actuator-controlling, directional control valve 11, and further to the actuator controlled by the reserve-actuator-controlling, directional control valve 11. Accordingly, the actuator controlled by the reserve-actuator-controlling, directional control valve 11 can be operated at a fast speed by the pressure oil from the two hydraulic pumps 1,2.

As has been described above, when one of the arm control device 22, the boom control device 21 and the right travel motor control device 18 is operated while the reserve actuator control device 24 is being operated or substantially at the same time of an operation of the reserve actuator control device 24, a pilot pressure produced as a result of the operation is detected by one of the first pressure sensor 50, the second pressure sensor 51 and the third pressure sensor 52, and a corresponding electrical signal is inputted to the corresponding one of the arm-dumping function generator unit 41, the boom-raising function generator unit 42 and the right-travel-motor-driving function generator unit 43 illustrated in FIG. 7. When desired one of the control devices 22,21,18 is operated over a large stroke, the value of the detected arm-dumping pilot pressure Pa, boom-raising pilot pressure Pb or right travel pilot pressure Pt becomes large. As a consequence, the value of the corresponding one of the target values Aa,Ab,At becomes smaller. The target value Aa, Ab or Ac of the small value is inputted to the minimum target value selector unit 44, where the small value is selected as a minimum target value Am. This minimum target value Am is inputted to the control signal generator unit 45. Here, this minimum target value Am is relatively small so that the input current i takes a large value. The input current i of the large value is fed as control signal from the controller 40 to the drive portion of the selective control valve 28*a*. As a result, the selective control valve 28*a* is changed over in accordance with the value of the control signal, namely, the input signal i toward the upper changed over position as viewed in FIG. 5, in other words, toward the closed position, and the branch line 27*a* is brought into a constricted state with a reduced opening area. An output pressure Pr guided through the shuttle valve 26, the pilot line 27 and the branch line 27*a* and outputted from the selective control valve 28*a* takes a relatively small valve and therefore, drives the merge control valve 14 such that its valve opening area is reduced.

Figure 8:
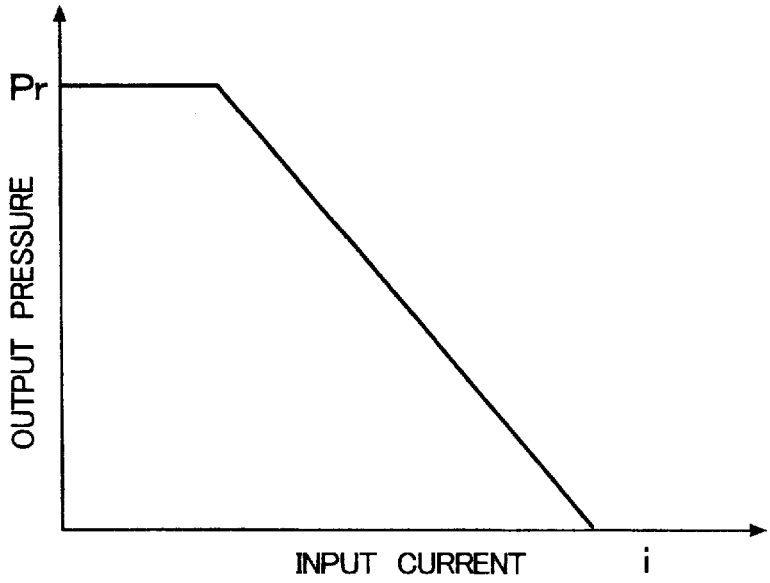
FIG. 8 is a diagram illustrating output pressure characteristics of a selective control valve arranged in the third embodiment shown in FIG. 5.
Figure 9:
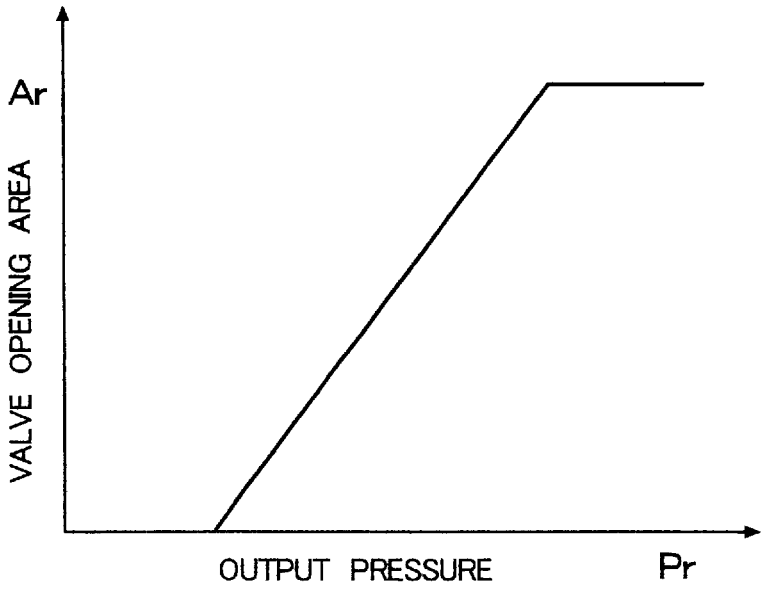
FIG. 9 is a diagram illustrating characteristics on a valve opening area of a merge control valve arranged in the third embodiment shown in FIG. 5.

FIG. 8 illustrates a relationship between the input current i fed from the above-mentioned controller 40 to the drive portion of the selective control valve 28*a* and the output Pr outputted from the selective control valve 28*a*. They are correlated such that the output pressure Pr becomes lower as the value of the input current i becomes greater. FIG. 9, on the other hand, illustrates a relationship between the above-mentioned output pressure Pr and the valve opening area Ar of the merge control valve 14. They are correlated such that the valve opening area Ar becomes smaller as the output pressure Pr becomes lower.

As the pressure oil from the first hydraulic pump 1 is restricted at the merge control valve 14 in this state, the amount of the pressure oil to be supplied from the first hydraulic pump to the reserve-actuator-controlling, directional control valve 11 via the communication line 13 and the supply line 11*a* is changed to a smaller amount. A substantial portion of the pressure oil from the first hydraulic pump 1 can, therefore, be supplied to the desired one of the arm-controlling, second directional control valve 6, the boom-controlling, first directional control valve 5 and the travel-controlling, right directional control valve 3. It is accordingly possible to suitably practice a combined operation of the actuator operated by the reserve-actuator-controlling, directional control valve 11, to which actuator a relatively low load pressure is applied, and the actuator for the desired one of the unillustrated arm cylinder, boom cylinder and right travel motor, to which actuator a high load pressure is applied.

In the third embodiment constructed as described above, the actuator controlled by the specific directional control valve consisting of the arm-controlling, second directional control valve 6, the boom-controlling, first directional control valve 5 or the travel-controlling, right directional control valve 3, namely, the actuator to which a load pressure higher than that applied to the actuator controlled by the reserve-actuator-controlling directional control valve 11 can be driven together with the actuator controlled by the reserve-actuator-controlling directional control valve 11, thereby making it possible to achieve a good combined operation of these actuators and hence to improve the efficiency of the relevant work.

Further, the pressure oil supplied to the reserve-actuator-controlling directional control valve 11 during the combined operation of the actuator controlled by the specific directional control valve and the actuator controlled by the reserve-actuator-controlling directional control valve 11 is primarily the pressure oil delivered from the second hydraulic pump 2. The operating speed of the actuator controlled by the reserve-actuator-controlling directional control valve 11 is relatively slow. Upon single operation of the actuator controlled by the reserve-actuator-controlling directional control valve 11, however, both of the pressure oil from the first hydraulic pump 1 and the pressure oil from the second hydraulic pump 2 can be supplied to the reserve-actuator-controlling directional control valve 11. As a consequence, the actuator controlled by the reserve-actuator-controlling directional control valve 11 can be operated at a fast speed. As is appreciated from the foregoing, the third embodiment also makes it possible to change the maximum value of the operating speed of the actuator controlled by the reserve-actuator-controlling directional control valve 11 and, especially when the actuator controlled by the reserve-actuator-controlling directional control valve 11 is singly operated, to efficiently perform the intended work via the actuator.

Industrial Applicability

Owing to the construction as described above, the present invention can change the maximum value of the operating speed of the actuator controlled by the reserve-actuator-controlling, directional control valve and hence, can control the actuator at two speeds consisting of a slow speed and a fast speed. When the operating speed of the actuator is set at the fast speed, the efficiency of work by an attachment or the like, said work being performed by the operation of the actuator, can be improved. Further, the length of the communication line through which the first hydraulic pump and the reserve-actuator-controlling, directional control valve are connected with each other can be shortened, a pressure loss through the communication line can be reduced, and the actuator controlled by the reserve-actuator-controlling, directional control valve can be controlled with high accuracy. Furthermore, leakage of oil supplied to the communication line 13 can be prevented. This makes it possible to decrease occurrence of insufficiency in the amount of oil in the circuit and also to prevent contamination of surrounding equipment by such oil leakage. Moreover, line connecting work for the communication line can be obviated. This makes it possible to reduce the irksomeness of assembly work of the hydraulic drive system and hence to improve the efficiency of the assembly work.

According to the present invention, when a control device for a predetermined directional control valve, which is included in the first control valve group, is operated to operate the predetermined directional control valve in such a state that the pressure oil from the first hydraulic pump and the pressure oil from the second hydraulic pump are both supplied to the reserve-actuator-controlling directional control valve, the merge control valve control means is operated, the pressure oil from the first hydraulic pump and the pressure oil from the second hydraulic pump are supplied to the predetermined directional control valve and the reserve-actuator-controlling, directional control valve, thereby permitting an automatic transfer to a combined operation of the actuator controlled by the predetermined directional control valve and the actuator controlled by the reserve-actuator-controlling, directional control valve. Excellent operability is thus obtained.

According to the present invention, the first shuttle valve and the second shuttle valve are accommodated within the shuttle block which forms a single housing. A group of shuttle valves can be arranged together, thereby making it possible to realize the construction of the whole system into a compact structure.

According to the present invention, it is also possible to changethe maximum value of the operating speed of the actuator controlled by the reserve-actuator-controlling directional control valve. This makes it possible to drive the actuator at a relatively fast speed. When the actuator is driven at such a fast speed, the efficiency of work by an attachment or the like to be performed by operating the actuator can be improved. It is also possible to achieve a good combined operation of the actuator controlled by the reserve-actuator-controlling, directional control valve and the actuator controlled by a specific directional control valve belonging to the control valve group, in which the reserve-actuator-controlling, directional control valve is not included, and possibly applied with a load pressure higher than that applied to the actuator controlled by the reserve-actuator-controlling, directional control valve. Work intended to be performed by operating these actuators can, therefore, be performed with good efficiency.

What is claimed is:

1. A hydraulic drive system for a civil engineering or construction machine, said system comprising:

a first hydraulic pump and a second hydraulic pump;

a first control valve group connected to said first hydraulic pump;

a bypass on/off valve having an open position and a closed position for selectively maintaining a bypass passage in or out of communication, the bypass on/off valve being disposed on a most downstream side of said first control valve group;

a second control valve group connected to said second hydraulic pump and including a plurality of directional control valves including a reserve directional control valve;

a communication line connecting the most upstream side of said first control valve group with a supply line to said reserve directional control valve;

a merge control valve having an open position and a closed position to selectively open and close said communication line;

an interlocked control means for permitting an operation to change said merge control valve to said open position and said bypass on/off valve to said closed position in association with a change-over operation of a reserve control device for changing said reserve directional control valve;

a selective change means capable of selectively taking one of a state, in which said operation to change said merge control valve to said open position by said interlocked control means is feasible, and another state, in which said operation to change said merge control valve to said open position by said interlocked control means is infeasible;

wherein said first control valve group, said second control valve group, said communication line and said merge control valve are arranged in a single housing;

wherein said reserve directional control valve comprises a hydraulically-operated pilot valve, said reserve control device including a pilot-operated control device for outputting a pilot pressure to change said reserve directional control valve, and each of said merge control valve and said bypass on/off valve including a hydraulically-operated pilot valve;

wherein said interlocked control means includes a first shuttle valve, which is designed to detect a pilot pressure outputted from said reserve control device and is designed to output said pilot pressure as a pressure signal for changing said merge control valve to said open position and said bypass on/off valve to said closed position, and a first pilot line connecting said first shuttle valve with respective drive portions of said merge control valve and said bypass on/off valve;

wherein said selective change means includes a selective control valve arranged in a part of said first pilot line, which connects said first shuttle valve with said drive portion of said merge control valve, and is capable of selectively taking one of a first state in which a pilot pressure outputted from said first shuttle valve is able to be supplied to said drive portion of said merge control valve and a second state in which the pilot pressure outputted from said first shuttle valve is not supplied to said drive portion of said merge control valve;

a merge control valve control means for controlling said merge control valve such that said merge control valve is changed to said closed position in response to an operation of a predetermined directional control valve that is included in said first control valve group;

said predetermined directional control valve comprises a hydraulically-operated pilot valve, a predetermined directional control valve control device for changing over said predetermined directional control valve comprises a pilot control device for outputting a pilot pressure, said merge control valve control means includes a second shuttle valve, which is adapted to detect a pilot pressure outputted from said predetermined directional control valve control device and is adapted to output said pilot pressure as a pressure signal for changing over said merge control valve, and a second pilot line communicating said second shuttle valve with a drive portion of said merge control valve.

2. The hydraulic drive system according to claim 1, wherein said selective control valve comprises a solenoid valve, and wherein said selective change means includes a selector switch for outputting an electrical signal to selectively actuate said selective control valve such that said selective control valve is maintained in one of said first state and said second state.

3. The hydraulic drive system according to claim 1, wherein said first shuttle valve and said second shuttle valve are accommodated within a shuttle block composed of a single housing.

* * * * *